US010989505B2

(12) United States Patent
Redeker et al.

(10) Patent No.: US 10,989,505 B2
(45) Date of Patent: Apr. 27, 2021

(54) PROPULSION SYSTEM FOR CARTRIDGE AMMUNITION

(71) Applicant: RHEINMETALL WAFFE MUNITION GMBH, Unterleuss (DE)

(72) Inventors: Hendrik Redeker, Grosshansdorf (DE); Stephan Dehrmann, Eschede (DE); Lars Dierks, Gross Roennau (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 0 days.

(21) Appl. No.: 16/685,560

(22) Filed: Nov. 15, 2019

(65) Prior Publication Data

US 2020/0263961 A1 Aug. 20, 2020

Related U.S. Application Data

(63) Continuation of application No. PCT/EP2018/061398, filed on May 3, 2018.

(30) Foreign Application Priority Data

May 18, 2017 (DE) ..... 10 2017 110 871.8

(51) Int. Cl.
*F42B 5/067* (2006.01)
*F42B 3/24* (2006.01)
*F42C 19/08* (2006.01)

(52) U.S. Cl.
CPC ..... *F42B 5/067* (2013.01); *F42B 3/24* (2013.01); *F42C 19/083* (2013.01); *F42C 19/0807* (2013.01)

(58) Field of Classification Search
CPC .. F42B 5/067; F42B 3/24; F42B 5/307; F42C 19/0807; F42C 19/083; F42C 19/0826; F42C 19/0823
(Continued)

(56) References Cited

U.S. PATENT DOCUMENTS 3,431,852 A * 3/1969 Fowler ..... F42B 12/625 102/334
3,446,146 A * 5/1969 Gawlick ..... F42C 19/083 102/470

(Continued)

FOREIGN PATENT DOCUMENTS

AU 2013292784 B2 1/2014
DE 39 18 005 A1 4/1990

(Continued)

*Primary Examiner* — Joshua E Freeman
(74) *Attorney, Agent, or Firm* — Muncy, Geissler, Olds & Lowe, P.C.

(57) ABSTRACT

A fragment-free propulsion of a cartridge-type ammunition, including a propellant casing and a high-pressure chamber, wherein the high-pressure chamber accommodates a propellant powder and, in the bottom region, a primer, having at least one overflow bore. To avoid fragments, a membrane, which separates the high-pressure chamber and a low-pressure chamber from one another and which does not tear to connect the high-pressure chamber to the low-pressure chamber when pressure is built up but instead is bent, is embedded in the high-pressure chamber. For this purpose, the high-pressure chamber additionally has a cap, the membrane, and a body. The membrane is embedded in the body and is secured by the cap. In addition, the membrane covers a gap that is formed by an outer diameter of the cap and an inner diameter of the body, and into which the membrane is bent when pressure is built up.

13 Claims, 2 Drawing Sheets

(58) Field of Classification Search
USPC ..... 102/430
See application file for complete search history.

(56) References Cited

U.S. PATENT DOCUMENTS

| | | | | | |
|---|---|---|---|---|---|
| 3,707,918 | A * | 1/1973 | Dunfee | F42B 12/50 | 102/370 |
| 3,771,451 | A * | 11/1973 | Woodring | F42B 5/02 | 102/430 |
| 3,983,817 | A * | 10/1976 | Tucker | F42B 12/50 | 102/513 |
| 4,478,150 | A * | 10/1984 | Sayler | F42B 5/073 | 102/430 |
| 4,619,202 | A * | 10/1986 | Romer | F42B 5/02 | 102/443 |
| 4,762,068 | A * | 8/1988 | Lubbers | F42B 12/48 | 102/439 |
| 4,907,511 | A * | 3/1990 | Bulman | F41A 1/04 | 102/440 |
| 4,938,145 | A * | 7/1990 | Martwick | F42B 5/045 | 102/434 |
| 4,938,146 | A * | 7/1990 | Gunther | F42B 5/067 | 102/439 |
| 4,969,397 | A * | 11/1990 | Gunther | F42B 5/02 | 102/233 |
| 5,834,681 | A * | 11/1998 | DuBay | F42B 5/02 | 102/430 |
| 5,936,189 | A * | 8/1999 | Lubbers | F42B 12/38 | 102/439 |
| 6,041,712 | A * | 3/2000 | Lyon | F42B 5/02 | 102/439 |
| 6,832,557 | B2 * | 12/2004 | Torsten | F42B 8/10 | 102/439 |
| 7,107,909 | B2 * | 9/2006 | Haeselich | F42B 8/02 | 102/439 |
| 7,793,591 | B1 * | 9/2010 | Van Stratum | F42C 9/10 | 102/443 |
| 7,930,977 | B2 * | 4/2011 | Klein | F42B 12/46 | 102/447 |
| 8,316,769 | B2 * | 11/2012 | Wilson | F42B 12/64 | 102/444 |
| 8,505,456 | B2 | 8/2013 | Haeselich | | |
| 8,573,137 | B2 | 11/2013 | Sullivan et al. | | |
| 9,557,150 | B2 | 1/2017 | Blackbeard | | |
| 2005/0268808 | A1 * | 12/2005 | Werner | F42C 19/0823 | 102/470 |
| 2007/0151473 | A1 * | 7/2007 | Brunn | F42C 19/083 | 102/444 |
| 2010/0288152 | A1 * | 11/2010 | Luebbers | C06B 23/00 | 102/430 |
| 2012/0247360 | A1 * | 10/2012 | Haeselich | F42B 30/04 | 102/430 |
| 2013/0239836 | A1 * | 9/2013 | Aw | F42B 5/02 | 102/430 |
| 2016/0238362 | A1 * | 8/2016 | Blackbeard | F42B 5/285 | |
| 2018/0238665 | A1 * | 8/2018 | Dumont | F42B 5/26 | |
| 2019/0310061 | A1 * | 10/2019 | Palo | F42C 19/08 | |
| 2020/0263961 | A1 * | 8/2020 | Redeker | F42B 5/02 | |

FOREIGN PATENT DOCUMENTS

| | | | |
|---|---|---|---|
| DE | 197 38 937 | A1 | 3/1999 |
| DE | 10 2009 048 365 | B3 | 10/2010 |
| DE | 102011014402 | A1 | 9/2012 |
| DE | 10 2012 014 043 | B4 | 2/2014 |
| DE | 112014002114 | B4 | 6/2016 |
| EP | 0 237 711 | A2 | 9/1987 |
| EP | 2 473 816 | B1 | 3/2015 |
| WO | WO 91/10877 | A1 | 7/1991 |
| WO | WO2013010675 | A1 | 1/2013 |

* cited by examiner

PROPULSION SYSTEM FOR CARTRIDGE AMMUNITION

This nonprovisional application is a continuation of International Application No. PCT/EP2018/061398, which was filed on May 3, 2018, and which claims priority to German Patent Application No. 10 2017 110 871.8, which was filed in Germany on May 18, 2017 and which are both herein incorporated by reference.

BACKGROUND OF THE INVENTION

Field of the Invention

The present invention relates to a propulsion system or to a propulsion and a cartridge ammunition with this propulsion system. The invention proposes, in particular, a fragment-free propulsion for this cartridge-type ammunition.

Description of the Background Art

Such cartridge ammunitions, for example caliber 40 mm×46, 40 mm×53, etc., formed of a propulsion system and a projectile. The propulsion system itself includes a propellant casing, at least one high-pressure chamber, a propellant powder, and a primer. A low-pressure chamber is formed in the propellant casing below the projectile and around the high-pressure chamber. The cartridge ammunition operates with a low gas pressure in the barrel. The high-pressure chamber thus serves the purpose of complete powder combustion. When the primer is triggered, a minimal gas pressure is reached in the high-pressure chamber in order to initiate uniform combustion of the propellant powder before the gas pressure flows into the low-pressure chamber. For this purpose, cups or disks made of metal or plastic are provided that burst or are perforated by the pressure.

EP 2 473 816 B2, which corresponds to U.S. Pat. No. 8,573,127, describes a cased ammunition comprising a cartridge casing and a projectile that is inserted into the cartridge casing and is mechanically secured to the cartridge casing. Located in the propellant chamber of the cartridge casing is a pyrotechnic propellant charge that is ignited by means of a pyrotechnic igniter whose propellant gases exert a force on the base of the projectile when they burn, by means of which the projectile is driven out of the cartridge casing. At least one passage exits from the propellant chamber through the cartridge casing that is/are filled with a fusible, solid, pressure-tight material. In this design, at least one non-fusible, rupturable element is positioned between a fusible, solid, pressure-tight material and the propellant charge.

The grenade in DE 10 2012 014 043 B4 has a high-pressure chamber that is subdivided by a rupture membrane into a first chamber section containing the propellant charge and a second chamber section.

DE 39 18 005 A1 relates to a cartridge-type ammunition wherein the propellant gases of the priming charge are released through a rupture disc.

The formation of fragments or particles that could interfere with the weapon function is disadvantageous in this context.

From DE 197 38 937 C2 is known a cartridge-type ammunition in which a piston is compressed in order to expose the overflow bores. The advantage resides in that the piston is not fragmented in this case.

SUMMARY OF THE INVENTION

It is therefore an object of the present invention to provide a propulsion that does not produce fragments but opens reliably at a defined pressure.

The invention is based on the idea of creating a fragment-free propulsion in order to take into consideration the increasing safety requirements.

For this purpose, a high-pressure chamber in the cartridge is centrally sealed by a single metal membrane below overflow bores.

A membrane sealing the transition between high-pressure chamber and low-pressure chamber is already described by DE 10 2009 048 365 B3, which corresponds to U.S. Pat. No. 8,505,456, which is incorporated herein by reference. A cartridge-type ammunition formed of a projectile and a propellant casing for accommodating the projectile and also a propulsion is disclosed in DE 10 2009 048 365 B3 that includes a mechanical connection between projectile and propellant casing. The projectile and propellant casing are screwed together. This threaded connection includes a membrane with at least one predetermined breaking point that opens at a predetermined pressure in the high-pressure chamber of the propulsion. Alternatively, the mechanical connection can also be a plug-in connection. After the opening of the connecting membrane, an annular throttle cross section is produced that regulates a controlled overflow of the propellant powder gases.

However, the present invention does not use a membrane with a predetermined breaking point. Moreover, the membrane is not incorporated into the mechanical connection. The mechanical connection is realized through a body of a high-pressure chamber and a projectile base. This can be accomplished via a threaded connection, etc.

Instead, the membrane is pressed by a cap in the axial direction against a shoulder in a high-pressure chamber. An annular gap that is closed by the membrane remains between the outer diameter of the cap and an inner diameter of the high-pressure chamber. When the ammunition is fired, the gas pressure from the propellant powder bends the membrane up and is able to flow out through this gap. This design prevents, in particular, the formation of radial fragments. It is possible for multiple overflow bores, but at least one, that create a connection between the high-pressure chamber and a low-pressure chamber of the ammunition to be connected to the gap.

The membrane is not secured to the body of the high-pressure chamber in the edge region, so only a pure bending without shear stress arises and the formation of fragments is precluded. The specific minimum opening pressure can be set or predetermined by the thickness of the membrane, the strength of the material, and the size of the gap.

A material that is tough but that has a good deformability without tearing should be chosen as the material of the membrane. Options here include, e.g., aluminum, copper, or steel.

The geometry of the membrane can be, for example, a disk. This permits simple manufacture of the membrane, which can be punched from a sheet metal strip. Among the advantages is that a change in the material properties with respect to the specified material strength values is prevented.

Furthermore, with a suitably designed device the membrane can be punched directly out of the sheet metal strip into the high-pressure chamber and brought into its final position, by which means manufacture and installation of the membrane can take place in one operation. The cap securing the membrane can then be pressed into the body of the high-pressure chamber, in which process the cap preferably can snap into the body.

Proposed is a fragment-free propulsion of a cartridge-type ammunition, including a propellant casing and a high-pressure chamber. The high-pressure chamber accommodates a propellant powder and, in the bottom region, a primer. The high-pressure chamber has at least one overflow bore. To avoid fragments, a membrane is embedded in the high-pressure chamber in such a manner that this membrane separates the high-pressure chamber and a low-pressure chamber from one another, and does not tear to connect the high-pressure chamber and the low-pressure chamber to one another when pressure is built up in the high-pressure chamber, but instead is bent or deflected. For this purpose, the high-pressure chamber has a cap, the membrane, and a body. The membrane is embedded in the body and is secured by the cap. In addition, the membrane covers a gap formed by an outer diameter of the cap and an inner diameter of the body. The edge region of the membrane is pressed into this gap when pressure is built up.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
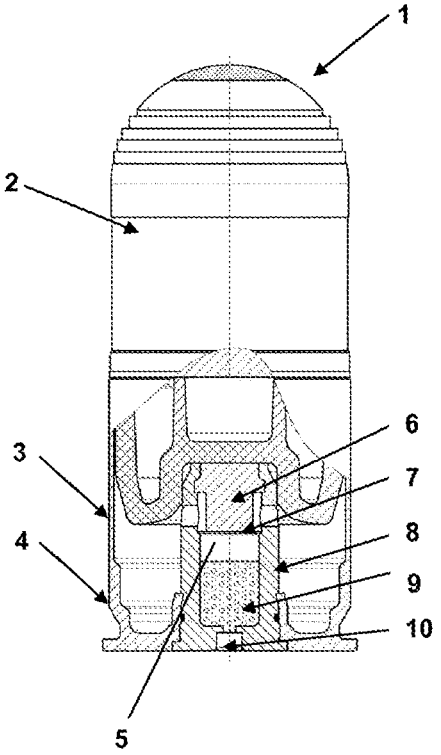
FIG. 1 shows a cartridge-type ammunition according to the invention in a partial sectional representation.

FIG. 1 shows a cartridge-type ammunition 1, formed of a projectile 2 and a propulsion 3. The propulsion 3 includes a propellant casing 4 and a high-pressure chamber 5. This high-pressure chamber 5 includes a cap 6, a membrane 7, a body 8, as well as a propellant powder 9, and a primer 10. The body 8 is hollow in design. The propellant powder 9 is located in a subarea of the body 8.

The membrane 7 can be embedded symmetrically in the body 8. The membrane 7 covers a gap 11 in this case. The gap 11 is formed by the outer diameter of the cap 6 and the inner diameter of the body 8. The size of the gap 11 can thus be set through the choice of the two diameters.

Figure 2:
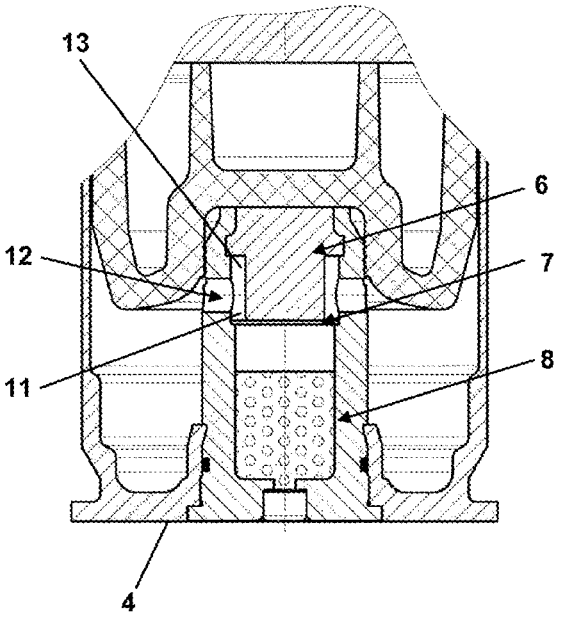
FIG. 2 is an enlarged representation of the high-pressure chamber from FIG. 1.

The high-pressure chamber 5 from FIG. 1 is shown in an enlarged view in FIG. 2. The membrane 7 seals overflow bores 12, at least one, which are functionally connected to the gap 11 via at least one connection 13, for example a circumferential annular groove. The membrane 7 is pressed against a shoulder 14 in the body 8 and secured thereto only by a cap 6. The overflow bores 12 are sealed with regard to the high-pressure chamber 5 by this membrane 7.

Even though the overflow bores 12 in this embodiment are placed in the body 8 such that they are oriented at right angles to the membrane 7, other orientations are also possible for connecting the high-pressure chamber 5 to a low-pressure chamber 15 of the ammunition 1. Hence, the overflow bores 12 can also be oriented to face at an angle upwards or downwards into the low-pressure chamber 15.

A mechanical connection 16 between the projectile 2 and propulsion 3 is created by the body 8 of the high-pressure chamber 5, wherein the body 8 is connected in the upper region 17 to a projectile base 18 of the projectile 2. The connection 16 between the body 8 and the projectile base 18 can be a threaded connection. For this purpose, the body 8 has an external thread in the region of the mechanical connection 16, and the projectile base 18 has an internal thread. Alternatives are possible. The body 8 carries the cap 6 in the upper region 17. This cap is secured in the body 8 in the upper region 17 of the body 8.

Figure 3:
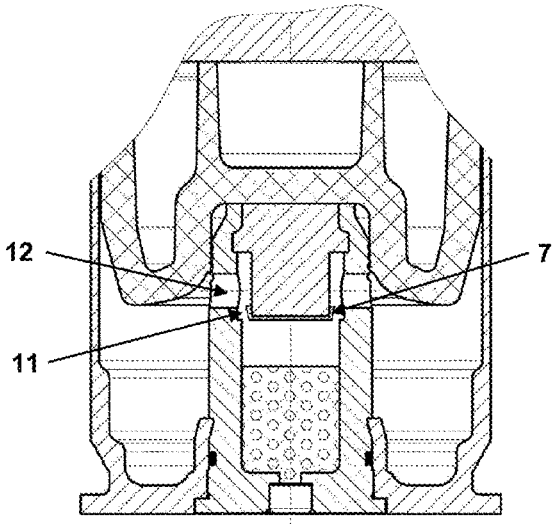
FIG. 3 is a representation of the high-pressure chamber with open membrane.

When the ammunition 1 is fired, the propellant powder 9 is ignited by the primer 10. When a predetermined or set propellant gas pressure is reached, the membrane 7 is pressed upward into the free gap 11 in the direction of the overflow bores 12 (FIG. 3). The required opening pressure can be set by design means through the dimensioning of the thickness and strength of the membrane 7 in combination with the surface that is subjected to pressure of the annular gap 11 between the body 8 and cap 6. The overflow bores 12 are exposed at this time. From the high-pressure chamber 5, the propellant gases arrive in the low pressure chamber 15 through the annular gap 11 and the overflow bores 12, and exert a force on the projectile base 18 by which the projectile 1 is driven out of the barrel of a weapon that is not shown in detail. The function of the membrane 7 ensures that no fragments, which could remain behind in the weapon as particles, etc., leave the high-pressure chamber 5.

Figure 4:
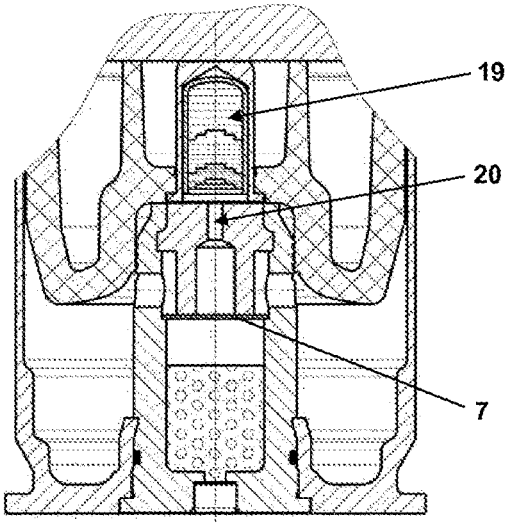
FIG. 4 is a propulsion with a tracer and flash-over bore.

In some ammunition variants or cartridge variants, a delay element or a tracer 19 may be provided in the projectile base 18. In order to be able to ignite this, an additional flash-over bore 20 is introduced axially, preferably in the cap 6 (FIG. 4). This central bore 20 makes it possible for the gas pressure from the high-pressure chamber 5 to be directed onto the delay element or onto the tracer 19, thereby igniting the delay element or the tracer 19. The flash-over bore 20 is sealed by the membrane 7, which shears off when pressure is built up.

Figure 5:
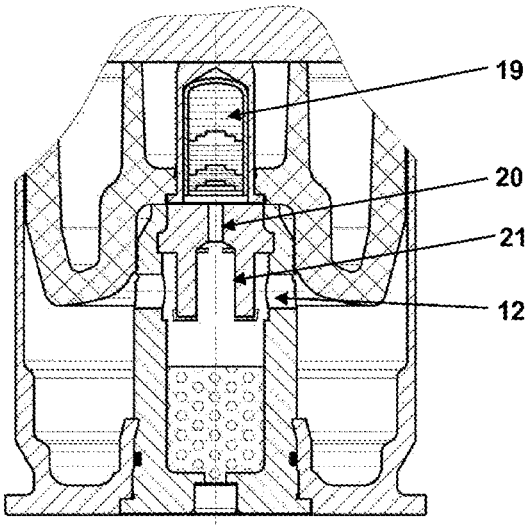
FIG. 5 shows the propulsion with tracer from FIG. 4 with open flash-over bore.

So that the flash-over bore 20 is opened simultaneously with the lateral overflow bores 12, a stepped bore 21 is located in front of the flash-over bore 20 (FIG. 5). The diameters of the two bores 20, 21 should be dimensioned such that the same opening pressure is set for shearing-off of the membrane 7 in the interior of the bore 21 as for the deflection of the membrane 7 in the outer region. The gas pressure pushes the sheared-off area of the membrane 7 to the end of the bore 21, where it is centrally perforated. In the end, a ring of the membrane 7 remains in the propulsion. The particle with the diameter of the flash-over bore 20 that is produced by the perforation is fired out of the high-pressure chamber 5, but burns up while still within the propulsion 3 on account of the high temperatures of the propellant powder gases. The propulsion 3 is fragment-free in this case as well, and reliable ignition of the delay elements or tracers 19 is ensured. Through the combination of external bending and shearing-off in the interior region, the propulsion 3 can reliably carry out both functions—projectile acceleration and ignition of a tracer/a delay element.

The proposed structural design of the propulsion 3 of the ammunition 1 permits simple manufacture of the propulsion 3. Hence, in a single production step the membrane 7 can be punched out of a sheet metal strip (not shown in detail) and virtually pressed into the body 8. In a subsequent production step the cap 6 is pressed into the body 8, and can then be fastened into the body 8 due to its shaping, preferably by snapping in.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A propulsion of a cartridge-type ammunition, comprising:

a propellant casing; and a high-pressure chamber, the high-pressure chamber comprising:

a propellant powder;

a primer in a bottom region;

at least one overflow bore;

a cap;

a membrane; and a body, wherein the membrane is embedded in the body and secured by the cap, and wherein the membrane covers a second gap formed by an outer diameter of the cap and an inner diameter of the body.

2. The propulsion according to claim 1, wherein the body has overflow bores that are covered by the membrane.

3. The propulsion according to claim 1, wherein a connection is introduced into the body between the overflow bores and the membrane.

4. The propulsion according to claim 1, wherein the membrane rests against a shoulder in the body.

5. The propulsion according to claim 1, wherein at least one connection, which is an annular groove, is present between the at least one overflow bore with the second.

6. The propulsion according to claim 5, wherein the connection is formed by recesses in the cap and body.

7. A cartridge-type ammunition comprising:

a propulsion according to claim 1; and a projectile.

8. The cartridge-type ammunition according to claim 7, wherein a mechanical connection between the projectile and the propulsion is created by the body of the high-pressure chamber.

9. The cartridge-type ammunition according to claim 8, wherein the body is connected in the upper region to a projection on the projectile base of the projectile.

10. The cartridge-type ammunition according to claim 8, wherein the connection between the body and the projectile base is a threaded connection.

11. The cartridge-type ammunition according to claim 7, further comprising a delay element or a tracer arranged in the projectile base and a flash-over bore arranged in the high-pressure chamber that extends to the projectile base.

12. The cartridge-type ammunition according to claim 11, wherein a stepped bore, which ensures shearing off of the membrane located below the flash-over bore in the interior region of the stepped bore when pressure is applied, is located in front of the flash-over bore.

13. The cartridge-type ammunition according to claim 11, wherein the flash-over bore and the stepped bore are integrated into the cap of the high-pressure chamber.

* * * * *